United States Patent [19]

Wahren

[11] 4,070,238

[45] Jan. 24, 1978

[54] HEADBOX FOR DELIVERING A JET OF WELL DISPERSED FIBROUS STOCK

[75] Inventor: Douglas Wahren, Karlstad, Sweden

[73] Assignee: Aktiebolaget Karlstads Mekaniska Werkstad, Karlstad, Sweden

[21] Appl. No.: 776,667

[22] Filed: Mar. 11, 1977

[30] Foreign Application Priority Data

Aug. 16, 1976 Sweden ..... 7609140

[51] Int. Cl.[2] ..... D21F 1/02; D21F 1/06

[52] U.S. Cl. ..... 162/343; 162/347

[58] Field of Search ..... 162/216, 336, 341, 343, 162/344, 347

[56] References Cited

U.S. PATENT DOCUMENTS

| | | | |
|---|---|---|---|
| 3,514,372 | 5/1970 | Boyce et al. | 162/343 X |
| 3,730,831 | 5/1973 | Stevens | 162/343 X |
| 3,791,918 | 2/1974 | Koskimies et al. | 162/343 |
| 3,802,966 | 4/1974 | Delekto et al. | 162/343 |
| 3,923,593 | 12/1975 | Verseput | 162/343 X |
| 3,945,882 | 3/1976 | Egelhof et al. | 162/343 X |

FOREIGN PATENT DOCUMENTS

| | | |
|---|---|---|
| 899,896 | 12/1953 | Germany. |

*Primary Examiner*—Richard V. Fisher
*Attorney, Agent, or Firm*—Brumbaugh, Graves, Donohue & Raymond

[57] ABSTRACT

Finely-mixed stock is produced in a headbox by delivering a multiplicity of separate stock streams at a relatively high velocity into passages defined between closely-spaced planar lamellae which extend parallel to the stock flow and oblique to a medial plane that lies axially and transversely of the fine-mixing stage that contains the lamellae. The stock flows at relatively low velocity in finely-mixed condition from the fine-mixing stage to a discharge nozzle, the axis of which lies at a substantial angle to the axis of the fine-mixing stage. The stock distribution and mixing section and the delivery nozzle of the headbox may be divided axially and transversely into two or more separate compartments for discharge of a jet composed of layers of the same or different stocks to form multi-ply webs. Different fiber orientations in different layers of such a multi-ply web are obtained by orienting the lamellae in the different chambers at substantially different oblique angles to the aforementioned axial-transverse medial plane of the fine-mixing stage.

14 Claims, 6 Drawing Figures

HEADBOX FOR DELIVERING A JET OF WELL DISPERSED FIBROUS STOCK

BACKGROUND OF THE INVENTION

Various fibrous materials, such as paper, paperboard, fiberboard and cellulose wet-lap, are made by forming a slurry or so-called stock of the fibrous material and other ingredients well dispersed in water and delivering the stock as a ribbon-like jet to a web former, such as the well-known Fourdrinier machine or a twin wire former. The mechanical properties and various other characteristics of the web produced by the web former are to a significant extent controlled by the characteristics of the stock delivered to the former from the headbox, and it is extremely important to the obtaining of high quality in the finished web that the fibers and other ingredients, such as fillers and additives, be thoroughly mixed in micro scale as well as macro scale. It is also important that the fibers be as free as possible of engagement with other fibers in the stock delivered from a headbox, i.e., that the fibers not be entangled in flocs.

Although to a considerable extent mixing of the stock occurs prior to feeding the stock to the headbox, one important function of a headbox is to give the stock a thorough final mixing so that the fibers and other ingredients are dispersed uniformly throughout the jet delivered through the slice opening. Among other important functions of a headbox are: the delivery of a precisely uniform thickness jet across the entire width of the former to ensure that the basis weight of the web is uniform; to deliver the stock jet at a controlled velocity to ensure uniformity of web properties from point to point lengthwise of the web and, particularly in twin wire formers, to control the mechanical properties of the web; to deliver a clean, smooth jet free of disturbances and irregularities, notably, machine direction streaks, waves due to velocity variations, water-hammer phenomena or wake effects from structures inside the headbox, and sprays of free drops.

Various headboxes that have been proposed or used over the past few decades have been equipped with elements intended to fulfill the mixing function of a headbox. Most of these elements are one or another form of obstruction interposed in the path of stock flow through the headbox to generate turbulence which, in turn, produces mixing. The obstructions have included baffles, perforated plates, rods, specially shaped vanes, perforated rolls and plates or sheets disposed parallel to the stock flow. Another approach has involved varying the cross section of the stock flow passages such as by providing projections extending from the walls of the headbox into the flow path. Vibrating plates and rods intended to induce mixing by mechanical vibration of the stock as it flows through the headbox have been tried. The various measures that have been proposed and used to enhance mixing of the stock in headboxes have, of course, been effective to various degrees, including some that have been quite successful. However, many of such measures have required trading off optimum results of one or more other functions of the headbox for improved mixing. For example, perforated plates are prone to clogging and to increasing the extent of floc formation due to the build up of flocs at the plates which break away periodically into the stock flow. Perforated plates and rods and vanes of various types also normally tend to produce wake effects that are reflected in streaks in the web. Some mixing devices have proven to be largely ineffective, for example, vibrating objects. Other mixing devices have been prone to mechanical failure from time to time, thus requiring shutdown of the machine for headbox repairs at very considerable costs in terms of lost production.

SUMMARY OF THE INVENTION

There is provided, in accordance with the present invention, a headbox that produces a well-mixed stock, in both macro scale and micro scale, is of strong, reliable, trouble-free construction, produces a stock layer free of wake effects and other across the sheet disturbances and delivers a smooth, well formed, coherent jet.

The headbox includes, as an important aspect of the invention, a fine-mixing stage that has exhibited the ability to form, for the first time, webs having a greater strength in the cross-machine direction than in the machine direction, i.e., an MD/CD tensile strength ratio of substantially less than 1.0. The structure of the headbox is such that it may be of smaller size and weight than comparable, previously known headboxes while still providing the required strength and rigidity.

The headbox comprises a stock mixing section which includes a rectifier stage constructed to produce a multiplicity of closely-spaced, relatively small-diameter separate streams of stock flowing at substantially higher velocities than the velocities of stock flow in other parts of the mixing section. Preferably, the rectifier stage consists of a pair of transverse plates spaced apart from each other in the direction of stock flow and having equal numbers of holes and tubes connecting the holes in the respective plates, thus to constitute a tube bank. The tubes of the rectifier stage should be of lengths not less than about 5 times, and preferably at least 15 times, the hydraulic diameters in order substantially to eliminate any cross flow tendencies that may exist in the stock flow as it leaves the large-scale mixing stage.

In addition to their function of separating the tubes, the transverse plates of the rectifier stage are structural elements of the headbox that impart strength and rigidity to it, particularly cross-machine rigidity that minimizes deflection of the walls of the stock delivery nozzle. Thus, the transverse plates reduce the need for externally located structural elements, and thus allow a reduction in the size of the headbox, as compared to presently known headboxes. When required, the rigidity of the headbox can be further increased by installing additional plates that extend between the tubes and are connected to the aforementioned pair of transverse plates.

The rectifier stage can, of course, be constructed in other ways, e.g., from a solid piece of material in which the rectifier "tubes" are holes drilled in the piece of material.

The mixing section further includes a fine-mixing stage that is located downstream from, and preferably immediately adjacent, the rectifier stage. The fine-mixing stage is constituted by a chamber of the stock mixing section of the headbox which is divided into a multiplicity of flow passages by closely-spaced planar lamellae oriented (1) substantially parallel to the medial axis in the flow direction of the fine-mixing chamber, and (2) oblique to an axial-transverse medial plane of the fine-mixing chamber, i.e., a plane defined by the axis in the flow direction of the fine-mixing chamber and by a medial line perpendicular to that axis and extending transversely of the fine-mixing chamber. The multiplicity of stock streams are delivered from the rectifier stage to the fine-mixing stage and produce in the passages between the closely-spaced lamellae relatively narrow eddies of low to medium intensity which produce medium to fine-scale mixing of the stock. The nature of the mixing action in the fine-mixing stage of the headbox is described in greater detail below.

The average superficial velocity of stock flow through the fine-mixing stage is substantially less than the velocity of stock flow through the rectifier stage, and the flow at the end of the fine-mixing stage is relatively calm and essentially free of large-scale eddies. The stock flows from the fine-mixing stage into a delivery nozzle defined by opposed converging walls that terminate in a slice opening, and the stock is thus smoothly and relatively rapidly accelerated to the desired delivery velocity. The axes in the flow direction of the nozzle and the fine-mixing stage preferably intersect at an angle of the order of from 95° to 120°. The relatively calm flow at the juncture between the nozzle and the fine-mixing stage permits the stock to turn without generating undesirable disturbances. To this end, the stock-receiving end of the stock delivery nozzle is designed such that the superficial velocity in the direction of flow towards the slice opening is essentially constant in the zone along the top of the fine-mixing (lamellae) stage.

The lengths and hydraulic diameters of the passages in the rectifier stage and the fine-mixing stage are chosen with the objective of creating turbulence of moderate intensity in the form of small to medium scale eddies in the passages between the lamellae. Because those passages are relatively narrow, the eddy currents tend to be predominantly aligned in directions parallel to the lamellae. The lengths and hydraulic diameters of the passages in the rectifier and fine-mixing stages are also chosen with a view to inducing the eddies generated in the fine-mixing section to make, on the average, several revolutions before leaving the fine-mixing section and entering the delivery nozzle, thus sustaining the mixing action within the fine-mixing stage for a relatively substantial period of time. The overall cross section of the fine-mixing stage is established such as to provide a relatively low average velocity of stock flow (of the order of 2 to 5 feet per second) in the fine-mixing stage so that the flow conditions of the stock upon entering the delivery nozzle are smooth and the stock can turn into the nozzle without the generation of large-scale disturbances.

There are a number of advantages resulting from turning the stock through a substantial angle from the downstream end of the fine-mixing stage to the nozzle. As described above, the moderately intense and relatively fine-scale turbulence in the fine-mixing stage is in the form of eddies that tend to be aligned parallel to the lamellae. As those eddies reach the end of the fine-mixing stage, they tend to be progressively peeled away into the nozzle such that the re-combination of individual flows of stock in the passages between the lamellae is by way of, with respect to any selected cross-machine location, a "sampling" of flows from several passages between lamellae. That sampling tends to produce a combined flow in the nozzle composed of layers, each of which comes from a different passage in the fine-mixing stage, but by making the turn, the peeling away of eddies from the passages in the fine-mixing stage takes place progressively and inherently provides a mixing effect on a scale of the order of the total width in the machine direction of the fine-mixing stage. The turning of the stock in entering the nozzle also tends to break up the eddies, enhance the fine-scale mixing of the stock, and prevent large scale eddies from forming.

Extensive testing on a pilot headbox has revealed an unexpected characteristic, the ability to produce a web having a greater strength in the cross-machine direction than in the machine direction (i.e., MD/CD ratios substantially less than 1.0). Although the precise reasons for the tendency for fibers in the web to attain an alignment that is on the average preferential in the cross-machine direction is not completely understood at the present time, such preferential fiber alignment may well result from the tendency for the eddies in the fine-mixing stage to be aligned parallel to the lamellae and the persistence of such alignment in the delivered jet upon smooth rapid acceleration of the flow in the nozzle. It has been found that within the normal ranges of selected relative velocities of the jet and the forming surface (surfaces in twin wire machines with drainage through both wires), fiber orientation and MD/CD ratio can be controlled over a greater range than is possible with presently known headboxes.

A headbox, according to the present invention, may, to considerable advantage, be constructed to form a multi-layer jet for the production in the former of a multi-ply web by providing transverse divider walls, as required, in the mixing and distribution section and in the delivery nozzle to maintain stocks delivered to the headbox from two or more sources separate until just prior to delivery through the slice opening.

In a multi-ply configuration of the headbox, the orientation of the lamellae in the fine-mixing stages of the respective compartments formed by the divider wall or walls can be made substantially different, preferably by skewing the lamellae in one compartment to the opposite hand from the lamellae in the other compartment. The abovementioned tendency for the fibers in the web to reflect the orientations of the lamellae results in a multi-ply web having different fiber orientations in the different layers, thus producing "a plywood effect" in that the fiber orientations in the different layers are at angles to each other and the overall strength characteristics of the total web are greater than the combined strengths of the individual layers of the web.

DESCRIPTION OF EXEMPLARY EMBODIMENTS

Figure 1:
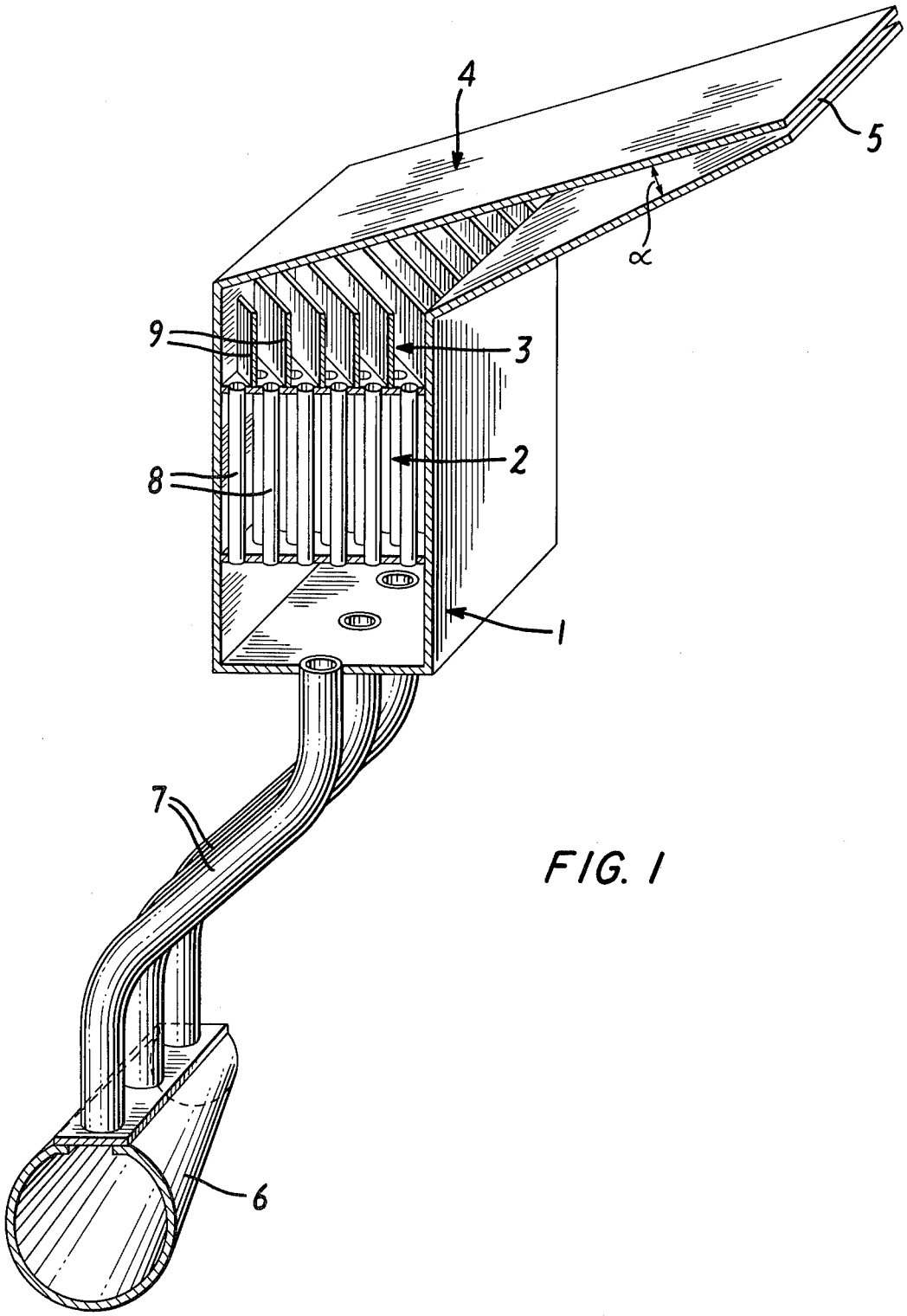
FIG. 1 is a perspective view in schematic form of an embodiment of a headbox, according to the present invention.

The headbox shown in FIG. 1 comprises a mixing and distribution section, which consists of a large-scale mixing stage 1, a rectifier stage 2 and a fine-scale mixing stage 3, and a delivery nozzle 4 composed of converging top and bottom walls terminating in a slice opening 5. Stock is delivered to the headbox from a cross-machine distributor 6 through a number of stock feed pipes or hoses 7.

The large-scale mixing stage of the headbox is simply an open chamber which receives stock at relatively high velocity from inlets from the pipes 7, which pipes may be anywhere from about 1 inch to 3 inches in diameter and spaced on a center-to-center distance of about twice the diameter. The entry of the streams of stock into the mixing chamber produces fairly intense, large-scale eddies and some degree of cross flow to provide mixing and distribution of the stock on a large scale. The chamber is made large enough so that the average velocity of flow through it is relatively low and flow disturbances resulting from velocity variations within the flow in the stage 1 will have only a negligibly small effect on conditions in the rectifier stage 2. The turbulence in the large-scale mixing stage keeps the lower (upstream) surface of the tube bank (described below) clean and free from lumps of stock that might otherwise build up on the entrance edges of the tubes.

Figure 3:
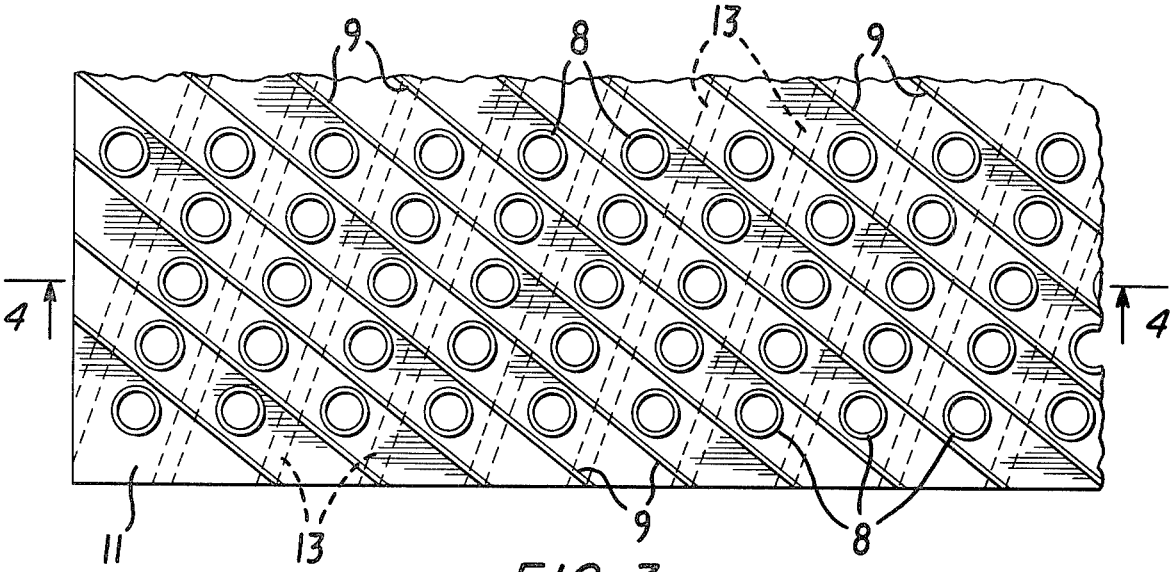
FIG. 3 is a cross-sectional view on an enlarged scale of a portion of the fine-mixing section taken along a plane substantially perpendicular to the axis in the flow direction.
Figure 4:
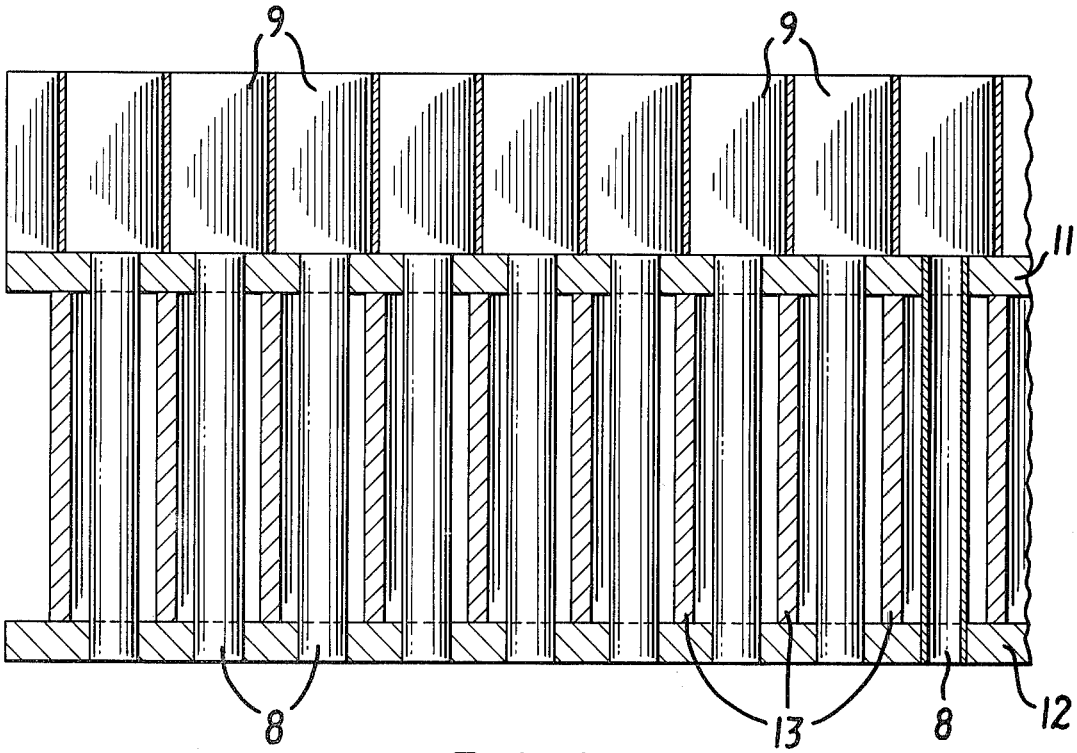
FIG. 4 is a cross-sectional view on a larger scale of a portion of the rectifier and fine-mixing stages of the headbox of FIG. 1.

The rectifier stage 2 consists of an array of tubes 8, each of which is of relatively small diameter and great length. In particular, the lengths of the tubes are sufficiently long to substantially eliminate any cross flow tendency that may exist in the flow as it leaves the mixing stage 1. In general, the tubes should have a length of not less than 5 times the hydraulic diameter and preferably a length of at least 15 times the hydraulic diameter. The tubes 8 extend between a pair of transverse plates 11 and 12 (see FIGS. 3 and 4) that are spaced from each other in the flow direction and are strongly secured to the perimeter walls of the headbox, thus to impart rigidity and strength to the headbox. The tubes are arranged in diagonally extending rows that are centered between plates or lamellae 9 of the fine-mixing stage 3 (described below and see FIG. 3), the tubes in each row being equidistant from each other and the rows being equidistant from each other. Generally, the spacings between the tubes in each row will be somewhat greater than the spacings between the rows, a situation that is controlled by the construction and mode of operation of the fine-mixing stage 3. The overall pattern of the tubes should, of course, be such as to provide an even distribution of stock flow across the headbox.

It is advantageous from the point of view of strength and rigidity of the headbox to install stiffeners 13 extending diagonally parallel to and between the tube columns in the shorter direction between opposite walls of the headbox and extending in the flow direction (axially) between the tube-mounting plates 11 and 12.

The fine-mixing stage 3 is a section of the headbox containing a series of planar lamellae 9. The lamellae are oriented parallel to the axis of the fine-mixing stage in the flow direction and oblique to an axial-transverse medial plane of the fine-mixing stage, thus to form a multiplicity of narrow separate flow passages that lie parallel to the axis of the headbox and oblique to the cross-machine direction. Each row of tube outlets 10 is located parallel to and centered between an adjacent pair of the lamellae.

Figure 2:
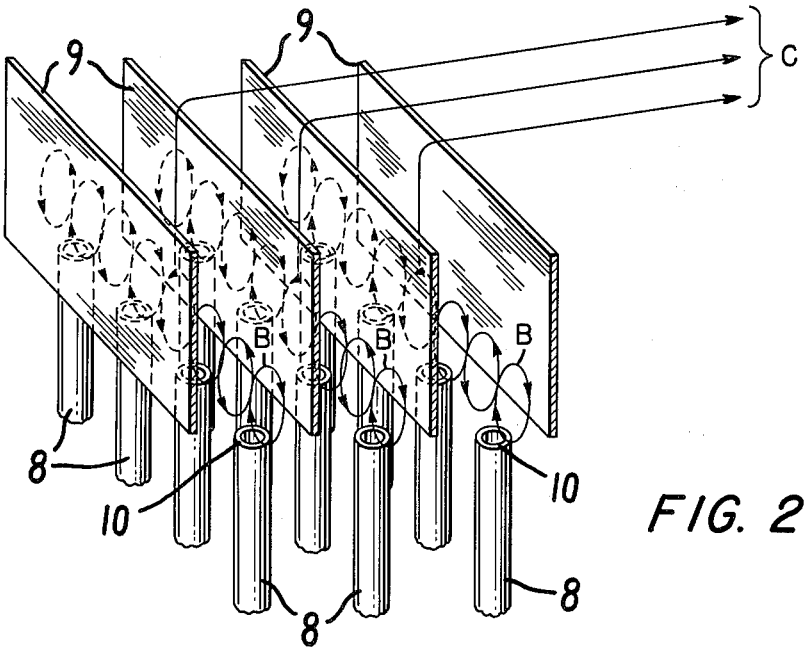
FIG. 2 is a diagram depicting very schematically on a relatively large scale the flow conditions in the fine-mixing section of the headbox of FIG. 1.

The flow conditions and the mixing action that occur in the fine-mixing stage 3 of the headbox are shown very schematically in FIG. 2. The streams of stock established by flow through the tubes 8 in the rectifier stage enter the fine-mixing stage at a relatively high velocity and upon encountering the stock in the fine-mixing stage, which is flowing at a substantially lower velocity, form relatively small eddies B of low to medium intensity. Because the spacing between the lamellae is relatively small, the eddies tend to become aligned parallel to the lamellae so that the overall flow in each passage between adjacent lamellae is made up predominantly of eddies circulating in planes generally parallel to the lamellae. The eddies move at relatively low average, superficial velocity in the direction of the tubes of the tube bank, preferably in the range of from about 2 to 5 feet per second, up through the passages between the lamellae. The interaction of the eddies as they are generated and move slowly through the fine-mixing stage provides a very effective fine-scale mixing action of relatively long duration. The skewed orientations of the passages between the lamellae also provide an opportunity for some cross flow to occur, thereby tending to eliminate any residual cross flow tendencies. The spacing between the lamellae 9, the distances between outlets 10 of the tubes in each row between adjacent lamellae, and the diameters of the tubes should be such that the eddies formed in the fine-mixing stage circulate on the average through several revolutions before leaving the fine-mixing stage.

The lamellae should, of course, be suitably fastened at each end to the walls of the headbox. The fact that the lamellae are oriented oblique to the axial-transverse medial plane of the fine-mixing stage makes them of relatively short length. Thus, they can be made of thin sheet material while still being sufficiently strong and durable to endure the relatively low intensity flow conditions of the stock as it moves through the passages between them. The heights of the lamellae in the flow direction should be not less than about 3, and preferably at least 5 times the perpendicular distance between them, which distance should be of the order of $\frac{3}{4}$ inch.

Upon leaving the fine-mixing stage 3, the stock enters the delivery nozzle 4 and in so doing makes a turn through a substantial angle, preferably of from about 60° to 85°. The stock leaves the fine-mixing stage at a relatively low velocity and essentially free of large-scale turbulence and thus is able to make the turn into the nozzle with a minimum of disturbance in the flow.

As depicted schematically in FIG. 2, the combined flow C of stock entering the nozzle 4 is, at any given cross-machine direction, made up of "samples" of stock that are "peeled" away successively from adjacent passages between the lamellae 9 in the fine-mixing stage. In making the abrupt turn from the fine-mixing stage to the nozzle, the eddies tend to be broken up. The stock flow in the nozzle tends, however, to remain layered with little physical intermixing of the layers, but the successive sampling effect of the peeling of stock flows from each passage in the fine-mixing stage produces additional mixing of the stock in the sense of combining in the nozzle elements of stock flowing from the different passages at different times. Thus, an element of stock flowing from portions of passages between the lamellae near the back of the headbox, relative to the slice opening 5, combines successively with elements of stock flowing from portions of the passages nearer the slice opening.

The length of the nozzle should be as short as possible in order to provide fast acceleration of the stock to the slice opening with a minimum of turbulence generation resulting from hydraulic shear adjacent the walls of the nozzle. On the other hand, the distance between the slice opening and the landing position of the jet in the former should be kept small. Therefore, the nozzle will generally be of a length that requires convergence of the nozzle walls at angles $\alpha$ (see FIG. 1) of from about 2° to 6°. The top and bottom walls of the nozzle may, if desired, be curved rather than straight.

Figure 5:
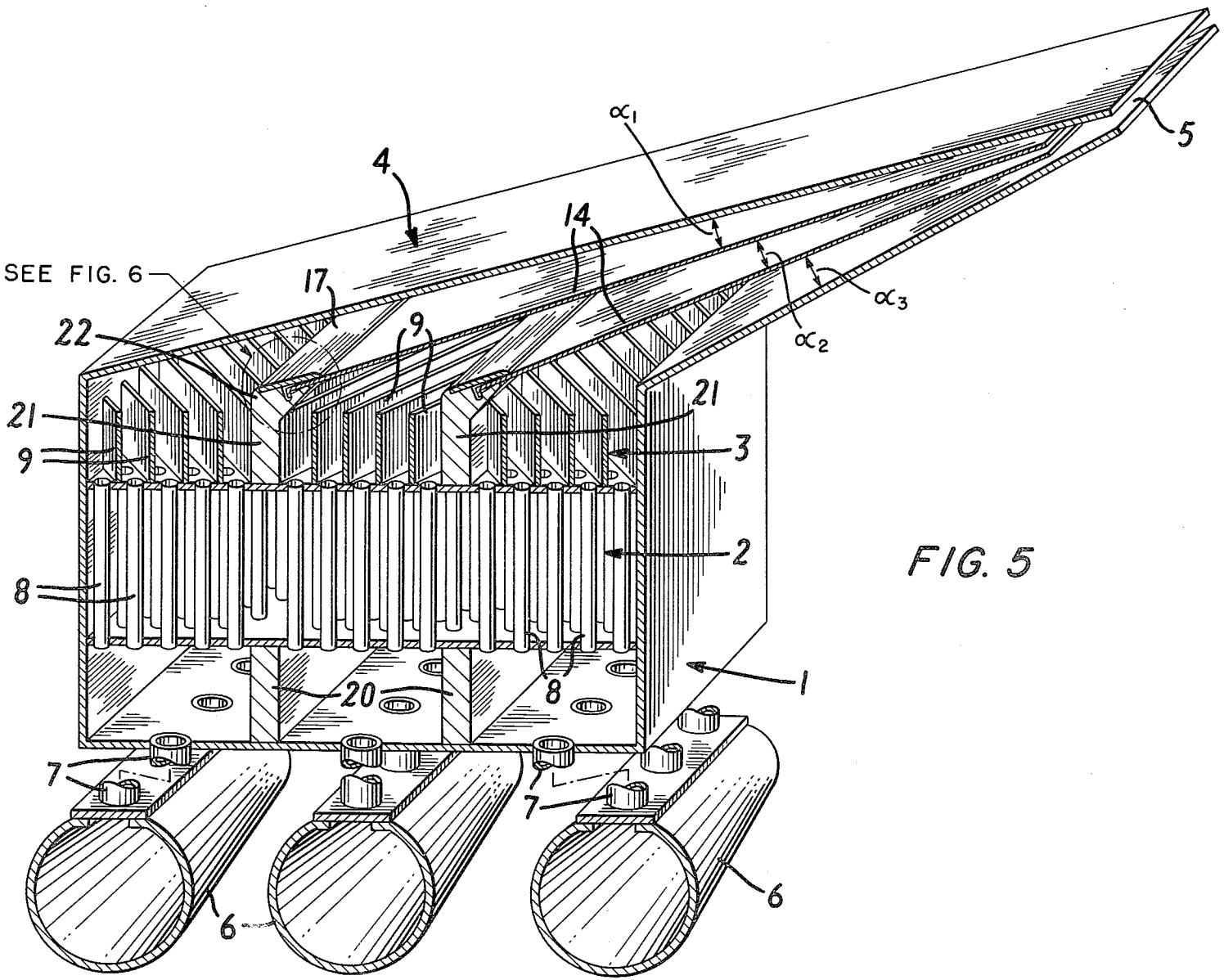
FIG. 5 is a pictorial view in schematic form of a multi-ply headbox.

Referring to FIG. 5 of the drawings, a headbox, according to the present invention, may be constructed to deliver a jet composed of separate layers of stock (separate in that there is little co-mingling between the stocks of the layers at the interfaces between them) for the production in the former of a multi-ply web. In the embodiment of FIG. 5, the distribution and mixing section of the headbox is composed, in essence, of three compartments separated from each other by divider walls 20 and 21 in the large-scale mixing stage 1 and the fine-mixing stage 3, such divider walls extending axially and transversely to form separate cross-machine compartments. Stock is delivered from separate distributors 6 through separate pipes 7 to the different compartments. Similarly, the delivery nozzle 4 is subdivided by divider walls 14 that extend transversely and in the flow direction and define three passages converging at angles $\alpha_1$, $\alpha_2$, and $\alpha_3$.

Figure 6:
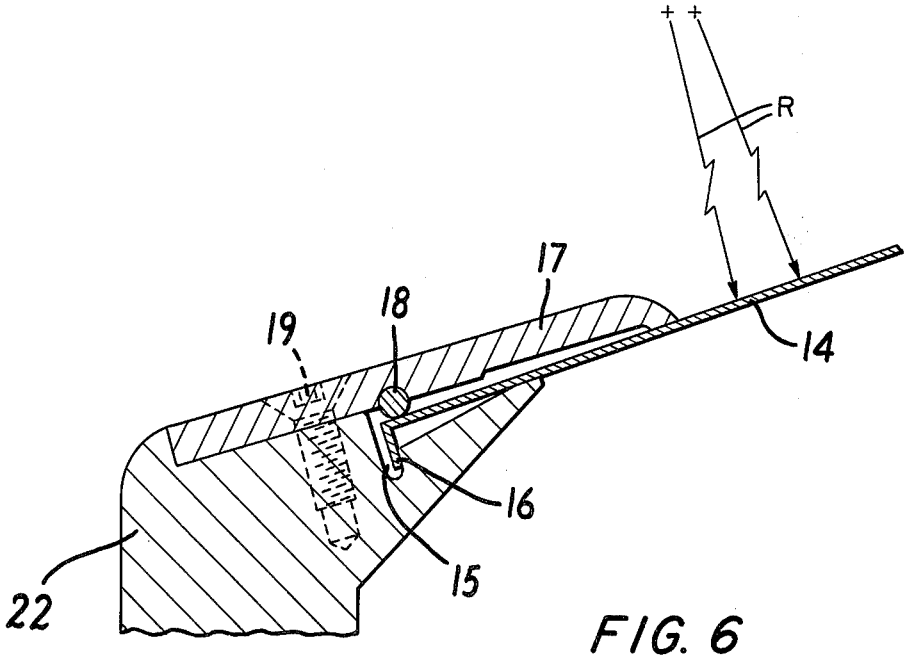
FIG. 6 is a side view showing the details of a mounting for a divider wall in the nozzle of the multi-ply headbox of FIG. 5, the view being of the region enclosed in the circle labelled "See FIG. 6" in FIG. 5.

In the embodiment shown in FIGS. 5 and 6, the divider walls 14 in the nozzle are stainless steel plates bent at their upstream ends to form flanges 16 (see FIG. 6). Each divider wall 14 is fastened at its upstream end to a holder formed by a jaw 22 provided on the upper end of the divider wall 21 of the fine-mixing stage and a jaw 17 fastened by screws 19 to the jaw 22. The flange 16 of the divider wall 14 is received and held in a slot 15 in the jaw 22 by a rod 18 that presses down on top of the divider wall 14 within the opening between the jaws. The divider walls 14 extend downstream in the nozzle and terminate a short distance, say about 2 inches, from the slice opening 5. Thus, the layers of stock are maintained separate until just before the stock is discharged through the slice opening.

In order to prevent warping of the divider walls 14 in the cross-machine direction, it is advantageous to construct and orient the jaws 17 and 22 in such a way that the divider walls 14 are held in positions in which they do not line up exactly in the direction of stock flow but point slightly below the slice opening. The hydraulic forces of the stock flow will then slightly bend the separating walls 14, and the imposed curvature, as depicted schematically by the arrowed lines "R" in FIG. 6, in the "vertical" direction ("vertical" as related to the drawings of FIGS. 5 and 6) will effectively prevent warping of the walls 14 in the cross-machine direction.

The form of divider walls 14 and the manner of installing them in the nozzle in the embodiment of FIGS. 5 and 6 are merely exemplary of various ways in which the delivery nozzle of the headbox can be subdivided into separate channels, and various other ways, including some that are known in the art, may be employed. For example, the divider walls may be tapered plates that are of substantial thickness at their upstream ends, tapered to thin tips or sharp edges at their downstream ends, the mounted on pivots or connected by hinge-type connections to supports, such as the tops of the divider walls 21, at the entrance to the nozzle.

The tendency for fiber orientation in the web to reflect the orientation of the lamellae in the fine-mixing stage of a headbox constructed in accordance with the present invention can be used to considerable advantage in a multiply headbox of the type shown in FIG. 5. In particular, the lamellae in the fine-mixing stage of one compartment can be oriented at a substantially different angle, preferably an angle of the opposite hand from the lamellae in other compartments. Thus, as shown in FIG. 5, the lamellae in the center compartment of the fine-mixing stage are oriented at an angle that is of a hand opposite from that of the lamellae in the outer compartments. The web formed of stock delivered from the headbox 5 will have fibers in the outer two layers oriented differently from the fibers of the middle layer, and the web will have a stiffness and strength greater than the sums of the stiffnesses and strengths of the individual layers and other mechanical properties that are enchanced by a "plywood" effect.

In some cases, it may be desirable to provide turning vanes at the intersection between the distribution and mixing section and the delivery nozzle of the headbox. In such cases, a construction very similar to that shown in FIG. 5, but with divider walls that extend only a few inches downstream from the end of the fine-mixing section into the delivery nozzle, can be provided. With such a construction, the layers delivered from the separate compartments of the fine-mixing stage will intermix to a somewhat greater extent than in the multi-ply configuration illustrated in FIG. 5. Similarly, the extent of intermixing of layers in a multiply configuration is subject to some control by varying the lengths of the divider walls 14 in the downstream direction, i.e., by varying the distance between the downstream ends of the divider walls and the slice opening. To this end, the divider walls may be built and installed in a manner that permits adjustment of the distance between the downstream tips of the divider walls and the slice opening.

I claim:

1. A headbox for delivering a stock of fibers carried in a liquid to a web former, comprising a stock mixing section which includes (a) a rectifier stage having means defining a multiplicity of closely-spaced flow passages through which the stock flows in separate streams at a substantially higher velocity than the velocities of stock flow in other parts of the mixing section and (b) a fine-mixing stage downstream, relative to the direction of stock flow through the headbox, from the rectifier stage, the fine-mixing stage including closely-spaced planar lamellae disposed (1) substantially parallel to the medial axis in the flow direction of the fine-mixing stage and (2) oblique to a medial transverse plane of the fine-mixing stage that is defined by the said axis and by a medial line perpendicular to said axis and extending transversely of the fine-mixing stage, and a stock delivery nozzle communicating with the mixing section downstream from the fine-mixing stage and defined by opposed converging walls terminating in a slice opening.

2. A headbox according to claim 1 wherein the said medial plane of the fine-mixing stage intersects a medial plane of the delivery nozzle that is (1) aligned with the stock flow therein and (2) transverse to the headbox at an oblique angle such that the stock flow in the headbox makes a substantial turn in flowing from the mixing section to the nozzle.

3. A headbox according to claim 2 wherein the medial plane of the fine-mixing stage intersects the medial plane of the delivery nozzle at an angle of from about 95° to 120°.

4. A headbox according to claim 1 wherein the fine-mixing stage is immediately adjacent the rectifier stage and the passages in the rectifier stage have outlets to the fine-mixing stage located in rows located between each adjacent pair of the lamellae in the fine-mixing stage, the outlets in each row being substantially equally spaced-apart from each other.

5. A headbox according to claim 1 wherein the lamellae are substantially equally spaced-apart from each other.

6. A headbox according to claim 5 wherein the passages in the rectifier stage have outlets to the fine-mixing stage located in substantially equally spaced-apart rows and wherein the outlets in each row are substantially equally spaced-apart from each other.

7. A headbox according to claim 1 wherein the lengths of the lamellae in the direction of stock flow in the fine-mixing stage are not less than about three times the spacing between adjacent lamellae measured perpendicularly to them.

8. A headbox according to claim 7 wherein said lengths of the lamellae are not less than about five times the said spacings.

9. A headbox according to claim 1 wherein the lengths of the flow passages of the rectifier stage in the direction of stock flow therethrough are not less than about five times the hydraulic diameters thereof.

10. A headbox according to claim 9 wherein the lengths of the flow passages are not less than about fifteen times the hydraulic diameters thereof.

11. A headbox according to claim 1 wherein the rectifier stage includes a pair of parallel plates spaced from each other in the direction of stock flow through the headbox and extending transversely across the headbox, each plate having an equal number of spaced-apart holes, and wherein the passages of the rectifier stage are defined by tubes, each of which extends from a hole in one of the plates to a hole in the other of the plates.

12. A headbox according to claim 11 wherein the rectifier stage further includes interconnected perimeter walls on all sides thereof and stiffener plates rigidly joined to opposite ones of the perimeter walls, such stiffener plates being disposed generally in alignment with the tubes and extending through spaces between them.

13. A headbox according to claim 1 adapted for delivery through the slice opening of essentially separate layers of stock for formation by the former of a multiply web and further comprising divider walls extending transversely across the mixing section and delivery nozzle and generally aligned with the stock flows therein, the divider walls subdividing the mixing section and nozzle into separate compartments and maintaining stock flows on opposite sides thereof separate.

14. A headbox according to claim 13 wherein the lamellae in the parts of the fine-mixing stage on opposite sides of the divider wall are at substantially different angles to said medial transverse plane to provide different alignments of the fibers in parts of the web formed from the stocks delivered from the separate compartments.

* * * * *